United States Patent [19]

Allen et al.

[11] Patent Number: 4,770,669

[45] Date of Patent: Sep. 13, 1988

[54] MAGNESIUM/HEAT-PROCESSABLE POLYMER FIRE STARTER MATERIAL AND APPARATUS

[76] Inventors: Charles E. Allen, 8414 Garland Ct., Arvada, Colo. 80005; Joseph B. Hines, P.O. Box 1117, McCall, Id. 83635

[21] Appl. No.: 53,399

[22] Filed: May 22, 1987

[51] Int. Cl.[4] ..... C10L 11/08

[52] U.S. Cl. ..... 44/45; 44/48

[58] Field of Search ..... 44/35, 39, 41, 42, 45, 44/48

[56] References Cited

U.S. PATENT DOCUMENTS 3,231,345 1/1966 Wilder ..... 44/41

4,417,900 11/1983 Barthel ..... 44/41

FOREIGN PATENT DOCUMENTS 49-28243 7/1974 Japan ..... 44/41

*Primary Examiner*—Carl F. Dees

*Attorney, Agent, or Firm*—Dorr, Carson, Sloan & Peterson

[57] ABSTRACT

A fire starter material is comprised of a mixture of magnesium and at least one heat-processable polymeric material. It can also be comprised of a mixture of magnesium and calcium carbonate or a mixture of magnesium, calcium carbonate and one or more heat processable polymeric materials. Binders such as waxes or resinous substances may also be present, especially in the presence of calcium carbonate. In one preferred embodiment of this invention, the heat-processable polymeric material also serves as such a binder. The fire starter material can be formed by compacting the magnesium/heat-processable polymeric material into the desired shape under high pressures and temperature capable of heat processing the polymeric material. For example, such formations can be achieved by sintering the material or by mixing the magnesium (or magnesium and calcium carbonate) with a heat-processable polymeric material such as a wax or resin in a liquid state to form a wet mixture and then pressing, extruding or injection molding the wet mixture into a desired shape.

9 Claims, 1 Drawing Sheet

MAGNESIUM/HEAT-PROCESSABLE POLYMER FIRE STARTER MATERIAL AND APPARATUS

BACKGROUND OF THE INVENTION

1. Field of the Invention

The present invention generally relates to solid fire starter materials which are ignitable by flint sparks. More particularly, this invention relates to fire starter materials employing magnesium as their chief combustible ingredient.

2. Description of the Prior Art

Various types of fire starters have been marketed for use by outdoorsmen, hunters, woodsmen and householders and others in igniting wood, charcoal and other materials, particularly when they are damp. Such fire starters have been made of such diverse materials as flammable chemicals in liquid or tablet form, elements such as zirconium or titanium in powdered forms, mixtures of wood particles and various resins, wax candles and various semi-solid chemical compounds sold in squeezable dispensing tubes.

Other fire starter materials have been based upon the ignition and burning characteristics of the element magnesium. Magnesium combines with oxygen to form magnesium oxide in the following highly exothermic reaction:

$$Mg + \frac{1}{2} O_2 \; MgO \; 143{,}940 \text{ cal./mole at } 25^\circ \text{ C.}$$

This reaction, burns with a dazzling white flame and produces a substantial amount of heat in the temperature range of 2700° C., to 2900° C. Because of the great amount of heat energy released by this reaction, only a very small amount of magnesium is need to kindle a fire. The prior art also discloses the use of various materials to control the burning characteristics of magnesium. That is to say, magnesium has been mixed, alloyed and compounded with various materials to control its burning characteristics when it is used in the context of fire starters.

However, despite the wide variety of fire starters now available, each type seems to have its own set of drawbacks.For example, most flammable chemical fire starters have one or more of the following disadvantages: (a) difficult ignition; (b) dangerous instability due to high flammability or low spontaneous ignition temperatures; (c) low burning temperatures; (d) short burning times; or (e) large volume requirements which make transport and storage difficult. Magnesium based fire starters overcome many of these disadvantages of the other chemical fire starters, but they are not without their own disadvantages. For example, many fire starters employing magnesium burn with a dazzling, but extremely short-lived, flame which often does not exist long enough to ignite the kindling material. Consequently various materials have been mixed with magnesium in order to better control its burning characteristics.

Most materials heretofore employed to control the above noted ignition and burning characteristics of magnesium have been elements, particularly those elements known as the rare earth elements. In this regard, the term "rare earths" usually implies the definition recommended by the Commission on Nomenclature of the International Union of Pure and Applied Chemistry. The Commission defines "rare earths" as consisting of those 17 element, namely, scandium, yttrium and the 15 elements having atomic numbers 57 through 71 for which the International Union recommends the term "Lanthanum Series". Aluminum, manganese, zinc, thorium and zirconium have also been widely used. It should also be noted in passing that many commercially available magnesium base alloys may also contain trace amounts of calcium copper, iron, nickel, and silicon. Such fire starter materials have been the subject of various patents.

For example, U.S. Pat. No. 3,402,029 teaches the use of misch metal to control the ignition and burning characteristics of a misch metal/magnesium alloy. The misch metal, which provides the sparking properties of the alloy, basically comprises the rare earth metals of cerium, lanthanum and praseodymium. Its most use is in the capacity as the pyrophoric substance employed in cigarette lighter flints.

U.S. Pat. No. 4,188,192 teaches a fire starter material comprised of a magnesium base alloy comprised of more than 50 percent by weight magnesium with the balance of the material being aluminum, manganese, zinc, thoranium, zirconium and/or the rare earths. Fire starter materials formed from such magnesium base/aluminum, manganese, zinc, thorium, zirconium, and/or the rare earths have good ignition qualities, but they are rather difficult to shave or whittle from the stock piece and also are, owing largely to the costs of their nonmagnesium ingredients, rather expensive.

The prior art has also recognized that some of the rare earth metals themselves, principally zirconium and titanium, in their pure or highly refined powder forms, have useful pyrophoric properties. They have been used as fulminators in flash bulbs and as ingredients in incendiary compositions for munitions to produce short bursts of intense heat or flame. However, such metal powders are generally recognized as being unsuitable for use in fire starter applications because of their tendency to flash-burn in short bursts measured in milliseconds. They also are characterized by low self-ignition temperatures which make them unstable and dangerous to handle. Nonetheless, U.S. Pat. No. 3,927,993 teaches how these dangerous characteristics can be overcome by the conjunctive use of low-grade zirconium sponge materials. However, these materials are both scarce and expensive.

Accordingly, there is still a need for more effective fire starter materials, especially those having all of the desirable characteristics of: small size, light weight, easy shavability of the stock piece, low cost, easy ignition (but with a high enough spontaneous ignition temperature to avoid accidental self-ignition), long burning time and high burning temperature.

SUMMARY OF THE INVENTION

This invention provides a fire-starting composition and device having all of the desirable characteristics of a fire starter material including high stability, easy shavability, easy ignition, a sufficiently high spontaneous ignition temperature, a high burning temperature, long burning time, small size, light weight, and low material and manufacturing costs. The invention also provides a simple low-cost device employing the disclosed fire starter composition. Its most obvious application is use by outdoorsmen, woodsmen, hunters and others interested in kindling wood or other materials commonly burned for warmth or cooking, especially under damp field conditions.

The foregoing objects, features and advantages of the invention will become more apparent from the following detailed description. The fire igniting apparatus aspect of the present invention comprises a composite structure having two distinct components. The first consists of a shavable magnesium/heat-processable polymer, and the second a pyrophoric element. The two materials are preferably secured together in such a manner that when a fire is to be ignited there is available to the person using the apparatus, a surface of a pyrophoric element, such as a flint, which can be struck with a metallic element. This arrangement can be effected in a number of different ways, examples of which will be described in more detail below.

In the practice of the method of the invention, an instrument such as a pen knife blade, file or the like is scraped against a surface of the shavable magnesium/-heat-processable polymer to produce finely divided particles or shavings of the fire starter material. These particulates and/or shavings are then consolidated in close proximity to a combustible kindling material. Thereafter, the same knife blade, file or the like instrument is brought into striking engagement against the surface of the pyrophoric element so as to produce a spark. Upon contact, the spark ignites the particulates of the magnesium/heat-processable polymer, causing the particulates to burn with an intense flame characteristic of burning magnesium, and thereby ignite the contiguous combustible kindling material.

Applicant has discovered that when magnesium particles are mixed with one or more heat-processable polymers and formed into a dense mass, the resulting materials make a very effective fire starter material. Such magnesium particles also can be mixed with calcium carbonate to form a similar dense mass which also serves as an effective fire starter material. Magnesium particles of less than about one quarter inch are preferred and powder particles of less than about 0.0331 inch (20 mesh, Tyler Screen Scale Equivalent Designation of U.S. Sieve Series) are even more preferred. When magnesium shavings are employed, the length of the shaving elements will preferably be less than about one inch in length.

The heat-processable polymer material (or multiple polymeric materials) may be initially associated with the magnesium particles, as solid particles, larger pellets or as liquids. In another preferred embodiment of this invention, the magnesium particles are bound to the calcium carbonate through the use of a binder material such as a wax (or waxes and a resin (or resins). Although less preferred, fire starter materials comprised of magnesium, calcium carbonate and heat-processable polymer(s) should also be considered as being within the scope of this patent disclosure.

In any event, the resulting fire starter material is also preferably comprised of magnesium in the form of particles or powders whose individual members are preferably less than one quarter inch and most preferably less than about 20 mesh in size. Most preferably the polymeric material and/or the calcium carbonate (as well as any binder material) will be mixed as powders with the magnesium ingredient. In all cases, however, the magnesium should comprise at least 50 percent by weight, and most preferably more than 75 percent by weight, of the resultant fire starter material. The remainder of the fire starter material (heat-processably polymer(s), calcium carbonate and/or binders or resins other than the heat-processably polymer(s) themselves) will comprise less than about 50% by weight of the resultant fire starter material. Most preferably calcium carbonate, when it is employed, will be less than about 25 percent by weight of the fire starter material. Similarly, when binders or resins other than heat-processable polymer materials will also be less than about 25 percent by weight of the fire starter material.

After the ingredients are mixed they can them be formed into a solid material by various well known heat and/or pressure related manufacturing processes such as molding, casting, injection molding, sintering etc. Such processes will be accompanied by sufficient heat to cause the ingredient to fuse. The resulting fire starter material will be a material which is hard enough to present a rigid shape, but still soft enough to be easily shaved or whittled by a knife or file operated by hand pressure. When injection molding is used to form the fire starter material, pressures obtained by known methods of between about 2,000 and 5,000 psi are highly preferred.

Some of the more preferred heat-processable polymer materials which can be used in the practice of this invention will include, but be limited to, natural thermoplastic waxes as well as synthetic thermoplastics such as polypropelene, acrylonitrile-butodiene-styrene, polyvinyl chloride, polyethylenes, (and particularly linear polyethelene high density polyethelene or ultra-high molecular weight polyethelene) acetal resins, acrylic resins, polystyrene resins nylons, polyurethane prepolymers and cellulosic resins. Natural thermoplastic waxes and cellulosic resins are preferably employed as binder materials in those fire starter materials using calcium carbonate in place of the heat-processable polymeric materials. However, in the more preferred embodiments of this invention, the heat-processable polymeric material(s) will also serve as a binder for the magnesium particles.

Similarly, the fire starter material can be formed by compacting the magnesium and heat-processable polymeric material or materials and/or the calcium carbonate into a desired shape such as a rod-like configurations. Ideally, this forming process is carried out under high pressures, e.g., those between about 2,000 and 20,000 psi. The magnesium and heat-processable polymeric material(s) may also be formulated and formed by mixing the magnesium (or magnesium and calcium carbonate) with a liquid, heat-processable polymeric material to form a wet mixture and then casting, pressing, extruding or molding the wet mixture into a desired shape. Sintering of the fire starter material is also a preferred forming process step.

In any case, the resulting fire starter materials will have ignition properties such that they (1) can be ignited by use of a pyrophoric medium such as a flint spark, (2) burn long enough e.g., at least twenty to thirty seconds to ignite surrounding kindling material such as wet wood, (3) have a high enough spontaneous ignition temperature to preclude the danger of accidental self-ignition and (4) are easily shaved or sliced from a stock piece of the fire starter material. Typically, fire starter materials formed from such materials typically will have spontaneous ignition temperatures of at least about 600° F., have maximum burning temperatures of about 2400° F. upon ignition, and have burn times of thirty seconds or more.

BRIEF DESCRIPTION OF THE DRAWINGS

Referring now to the drawings wherein like reference numerals indicate like parts in the various views.

DESCRIPTION OF THE PREFERRED EMBODIMENT

Figure 1:
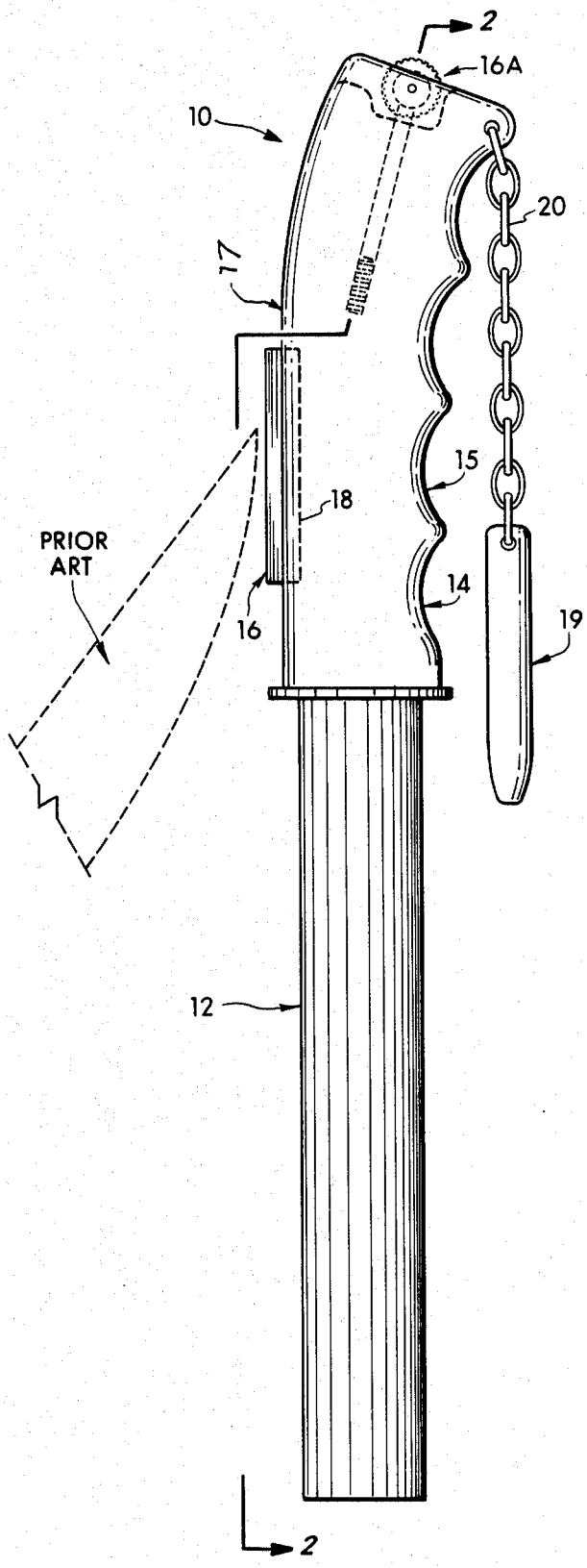
FIG. 1 is a side view of one embodiment of the fire igniting apparatus of the present invention.

Referring now to the details of the drawings, FIG. 1 illustrates a preferred embodiment of a fire starter apparatus 10 which generally comprises a shavable magnesium/heat-processable polymer (or calcium carbonate) stock member 12, a knife-like handle 14 and a pyrophoric element 16 such as a flint. FIG. 1 also depicts an alternative or supplemental pyrophoric element 16A such as a misch metal flint engaged by a wheel-like fire striking mechanism such as those frequently employed on cigarette lighters.

Pyrophoric element 16 is preferably attached to the handle 14 of the apparatus by embedding and gluing it in a recess 18 in the handle 14. Obviously the shape of the recess, e.g., round, should accommodate the shape i.e., round of the pyrophoric element 16. The pyrophoric element 16 should protrude above the top surface 17 of the handle 14. A pyrophoric element 16 such as flint can be struck with a steel striker 19 which can be attached to the handle 14 by a means of a chain, string, wire or other attachment means 20. The striker 19 is an optional element since any conveniently available steel item such as the blade of a knife (shown in FIG. 1 but not constituting an element of this patent disclosure) could be used to strike against the flint (or other pyrophoric material) to make sparks which serve to ignite shavings of the magnesium/heat-processable polymer (or calcium carbonate and/or binder) fire starter material taken from the stock member 12.

Figure 2:
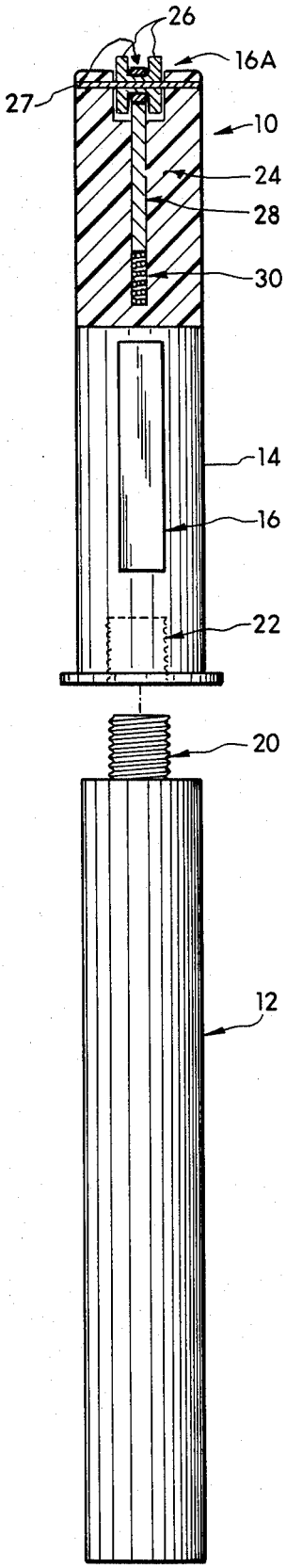
FIG. 2 is a cut-away, sectional and exploded end view of a preferred embodiment of the apparatus showing a preferred ignition device.

FIG. 2 shows an exploded, partially cut away end view of a preferred embodiment of the device 10 wherein the stock member 12 includes a threaded section 20 which cooperates with a threaded receptacle 22 in the bottom of the handle 14 so that the stock member 12 can be readily replaced after its bottom regions have been shaved and/or whittled away in use. FIG. 2 also shows a cut-away view of a star wheel striker mechanism 24 which typically comprises a thumb operated wheel or wheels 26 which turn an axle 27 against which a misch metal element 28 is engaged by a biasing means such as a spring 30 in order to produce the sparks needed to ignite a small pile of magnesium/heat-processable polymer (or magnesium/calcium carbonate) shavings taken from the stock member 12.

In the preferred embodiment illustrated in FIGS. 1 and 2, the pyrophoric element is shown as if affixed by glue to the body of magnesium base alloy. It will be appreciated, however, that many other means for affixing the pyrophoric element to the handle 16 may be provided. These may include compression fits, set screws, spring clamps, or other similar mechanical devices, or more simply, a combined gluing and press fit within an embracing channel 18 of the handle 14. As will be readily appreciated by those skilled in the art, the preferred mechanical devices for securing the pyrophoric element to the handle 14 should not interfere with the placing of the handle of the device in a scabbard or other means for holding the fire starter device.

As previously noted, the shaving stock member 12 may be formed from any magnesium/heat-processable polymeric, material(s) which, for purposes of this disclosure, are defined as a magnesium/heat-processable polymeric material or materials which is capable of being shaved with a knife blade or like instrument. As previously noted, the fire starter material preferably should contain at least 50 weight percent of magnesium with the remainder of the material being comprised one or more heat-processable polymeric materials. Shavings of these fire starter materials are further characterized by their being ignitable, particularly when in finely divided form, by a spark from a pyrophoric element, and by their ability to burn with a very hot white flame. In another embodiment of this invention, the balance of the fire starter material, is formed substantially of calcium carbonate and/or a binder such as a wax or resin. Most preferably the binder itself will be comprised of one or more of the preferred heat-processable polymer materials.

Compositions of the magnesium/heat-processable polymeric material will contain magnesium in a particle or powder form. When higher percentages of the heat-processable polymeric material are employed, the magnesium particles should be employed in a larger then powder or granule size, and more preferably be larger than sand grain size, and most preferably will be in the size and form of shavings, turnings or ribbons which are longer than one quarter inch and which are then bound in a matrix by the heat-processable polymeric material or the calcium carbonate and/or binder. Again, representative heat-processable materials would include both natural thermoplastic waxes as well as synthetic thermoplastics such as polypropelene, acrylonitrile-butodiene-styrene, polyvinyl chloride, polyethylenes, (and particularly linear polyethelene high density polyethelene or ultra-high molecular weight polyethelene) acetal resins, acrylic resins, polystyrene resins nylons, polyurethane prepolymers and cellulosic resins.

EXPERIMENTAL RESULTS

Various common commercially available heat-processable polymers were used to conduct the hereinafter described tests; they included:

| SAMPLE | FORM | GENERIC PLASTIC TYPE |
|---|---|---|
| 1 | ¾ inch rod | polypropylene |
| 2 | 1 inch rod | ABS (black) |
| 3 | ½ inch panel | PVC (grey) |
| 4 | ½ inch panel | high density polyethylene |
| 5 | 1 inch rod | acetal (Delrin) |
| 6 | 1" × "¾ bar | ultra-high molecular weight polyethylene |
| 7 | ⅞ inch rod | acrylic |
| 8 | 1 inch rod | styrene |
| 9 | rough block | nylon |
| 10 | rough bar | Nylatron |

The test procedures were as follows.

Scrapings of representative heat-processable polymeric materials were collected and used in various tests for ignition and burning. For example, 0.25 g of a heat-processable polymer material was mixed with 0.25 g of pure magnesium powder, (Supplied by JT Baker, lot No. 29,204). Mixing was done with a small dowel only;

the mixtures generally were not completely homogeneous. The mixture was placed at the center of three standard wooden tongue depressors (Puritan #705), arranged in a cross configuration. The material being tested was placed in the center of the crossed wooden tongue depressors.

A flint and striking device was used to ignite a pile of a given mixture of magnesium/heat-processable polymeric material. Several strikes were made if needed. The production of sparks with the flint and striker proved to be a somewhat random process; thus the number of strikes required to produce ignition was not always related wholly to the material being tested. If ignition did not occur after many attempts, an additional 0.25g of the magnesium powder was added to the mixture, and ignition was attempted again.

Most of the mixtures tested appeared to have the potential to start fires. Based upon the scraping properties and subjective evaluations of the burns, the heat-processably polymeric materials ABS and PVC appear to be particularly preferred for the formation of such fire starter materials.

Magnesium powder was also burned with calcium carbonate powder (JT Baker lot No. 1-1288) in various ratios. The calcium carbonate appeared to physically moderate the combustion by allowing a freer passage of air due to its very fluffy consistency. Oxygen may also be released by the calcium carbonate, and thereby aid in the combustion of the magnesium ingredient.

It also appeared that some of the heat-processable polymeric materials like wax may so completely encapsulate magnesium in the form of a fine powder to so great an extent that ignition is hindered. Apparently, the spark can not get to the magnesium. Hence, larger particles of magnesium, and most preferably magnesium shavings of greater than ¼ inch are highly preferred forms for the formulation of such fire starter materials.

Thus having described the preferred embodiments of our invention and several operable alternative embodiments and methods of manufacture, it should be apparent to those skilled in the art that the composition, particle size, pressures and methods of manufacture are capable of modification either alone or in conjunction with changes in the mechanical features of the device itself. Hence we also claim as our invention all such modifications as come within the true spirit and scope of the following claims.

Thus having described our invention, we claim:

1. In a fire igniting apparatus having a composite structure comprised of a hard, but shavable, stock piece having magnesium as an ingredient and a pyrophoric element secured to said fire igniting apparatus and defining an exposed or exposable surface thereof, wherein the improvement comprises a shavable stock piece which contains at least 50 weight percent magnesium with the remainder of the shavable stock piece comprising of a heat-processable layer.

2. In a fire igniting apparatus having a composite structure comprised of a hard, but shavable, stock piece having magnesium as an ingredient and a pyrophoric element secured to said fire igniting apparatus and defining an exposed or exposable surface thereof, wherein the improvement comprises a shavable stock piece which contains at least 50 weight percent magnesium with the remainder of the shavable stock piece comprising a heat-processable polymer selected from the group consisting of wax, polypropylene, acrylonitrile-butadrene-styrene, polyvinyl chloride, polyethylenes (and particularly linear polyethelene high density polyethelene or ultra-high molecular weight polyethelene) acetal resins, acrylic resins, polystyrene resins nylons, polyurethane prepolymers and cellulosic resins.

3. In a fire igniting apparatus having a composite structure comprised of a hard, but shavable, stock piece having magnesium as an ingredient, a pyrophoric element secured to said fire igniting apparatus and defining an exposed or exposable surface thereof, and wherein the improvement comprises a shavable stock piece containing at least 50 weight percent magnesium with the remainder of the shavable stock piece comprised of from about twenty to about forty weight percent of a heat-processable polymer selected from the group consisting of wax, polypropylene, acrylonitrile-butadrene-styrene, polyvinyl chloride, polyethylene, acetal resin, acrylic resin, polystyrene resin, nylon, polyurethane prepolymer and cellulosic resin and from about ten to about thirty weight percent calcium carbonate.

4. A hard but shavable fire starter material comprised of a mixture of at least 50 weight percent magnesium with the remainder of the material being a heat-processable polymer and wherein said fine starter material is made by subjecting a mixture of a magnesium and heat-processable polymer to a forming process selected from the group consisting of pressing, extruding, sintering, molding and injection molding.

5. The hard but shavable fire starter material of claim 4 wherein the heat-processable polymer is selected from the group consisting of wax, polyproplene, acrylonitrile-butadrene-styrene, polyvinyl chloride, polyethylene, acetal resin, acrylic resin, polystyrene resin, nylon, polyurethane prepolymer and cellulosic resins.

6. A hard but shavable fire starter material comprised of a mixture of at least 50 weight percent magnesium with the remainder of the material being calcium carbonate and wherein said fire starter is made by subjecting a mixture of magnesium and calcium carbonate to a forming process selected from the group consisting of pressing, extruding, sintering, molding and injection molding.

7. The fire starter material of claim 4 which further comprises at least 10 weight percent of a binder material.

8. A fire starter material comprised of a mixture of at least 50 weight percent magnesium, at least 30 weight percent heat-processably polymer with the remainder of the material being calcium carbonate.

9. The fire starter material of claim 8 wherein the heat-processable polymer is selected from the group consisting of wax, polyproplene, acrylonitrile-butadrene-styrene, polyvinyl chloride, polyethylene, acetal resin, acrylic resin, polystyrene resin, nylon, polyurethane prepolymer and cellulosic resins.

* * * * *